United States Patent [19]

Kreischer

[11] 4,055,347

[45] Oct. 25, 1977

[54] BOARD GAME APPARATUS

[76] Inventor: Lois A. Kreischer, 8 Indian Trail Court, Novato, Calif. 94947

[21] Appl. No.: 699,350

[22] Filed: June 24, 1976

[51] Int. Cl.[2] ..... A63F 3/00

[52] U.S. Cl. ..... 273/135 D; 273/134 AT; 273/135 AA; 273/135 AC

[58] Field of Search ..... 273/134, 135

[56] References Cited

U.S. PATENT DOCUMENTS

| | | | |
|---|---|---|---|
| 156,212 | 10/1874 | Elderkin | 273/135 D UX |
| 1,837,194 | 12/1931 | Baumgarten | 273/135 D X |
| 3,185,478 | 5/1965 | McTaggart | 273/135 D |
| 3,226,122 | 12/1965 | Rogers | 273/135 D X |
| 3,393,914 | 7/1968 | Hill | 273/135 D |
| 3,940,140 | 2/1976 | Meyer et al. | 273/134 C X |
| 3,961,795 | 6/1976 | Anspach | 273/134 C X |
| 3,984,106 | 10/1976 | White | 273/134 AB |

FOREIGN PATENT DOCUMENTS

| | | | |
|---|---|---|---|
| 968,246 | 4/1950 | France | 273/134 AB |

*Primary Examiner*—Delbert B. Lowe
*Attorney, Agent, or Firm*—Melvin R. Stidham

[57] ABSTRACT

A game-board with a series of spaces representing letters of the alphabet forming a continuous path along which game pieces are moved. Letter tiles, determined by the lettered spaces to which game pieces are moved, are purchased. Words from such letters are placed on a player's own word board, which has a limited number of horizontal and vertical spaces. There are four groups of letters, each valued in accordance with the difficulty of forming words therewith, and play money is awarded to players for the total of words formed.

9 Claims, 8 Drawing Figures

BOARD GAME APPARATUS

BACKGROUND OF THE INVENTION

There are a number of games available wherein play-money may be used to "purchase" property, stock shares or the like but these games are based almost completely on chance and have little educational value.

OBJECTS OF THE INVENTION

It is an object of this invention to provide a game-board apparatus wherein the fortunes of the game must necessarily be fostered by mental exercise.

It is a further object of this invention to provide a game apparatus which is both entertaining and educational.

It is a further object of this invention to provide a game apparatus which affords an entertaining way to increase one's vocabulary.

Other objects and advantages of this invention will become apparent from the description to follow, particularly when read in conjunction with the accompanying drawings.

BRIEF SUMMARY OF THE INVENTION

In carrying out this invention I provide a game-board which has delineated thereon a continuous path of spaces along which game pieces may be moved. Most of the spaces are marked to represent letters of the alphabet, and players are required to purchase, at the same fixed price, tiles or markers having letters corresponding to those on which the game piece lands. Each player has his own word board having a limited number of horizontal and vertical spaces on which the letter markers may be placed to form words. The letter tiles are in four groups with indicia thereon identifying each group as to the value thereof, in accordance with the difficulty of forming words therewith. For example, the vowels have the lowest value and letters like "*x*" and "*z*" are valued the highest. A player is rewarded for forming words of maximum length within the limited space available, and paid from the "bank" in accordance with the total value of the letter tiles used, with bonuses being awarded for words of five or more letters. Moves along the game-board path are determined by a throw of three dice, with the player having the option of moving in three increments in accordance with the three numbers thrown to purchase three letters; in two increments in accordance with a number thrown plus the sum of the other two dice; or in a single increment as determined by the total sum thrown.

DESCRIPTION OF A PREFERRED EMBODIMENT

Figure 1:
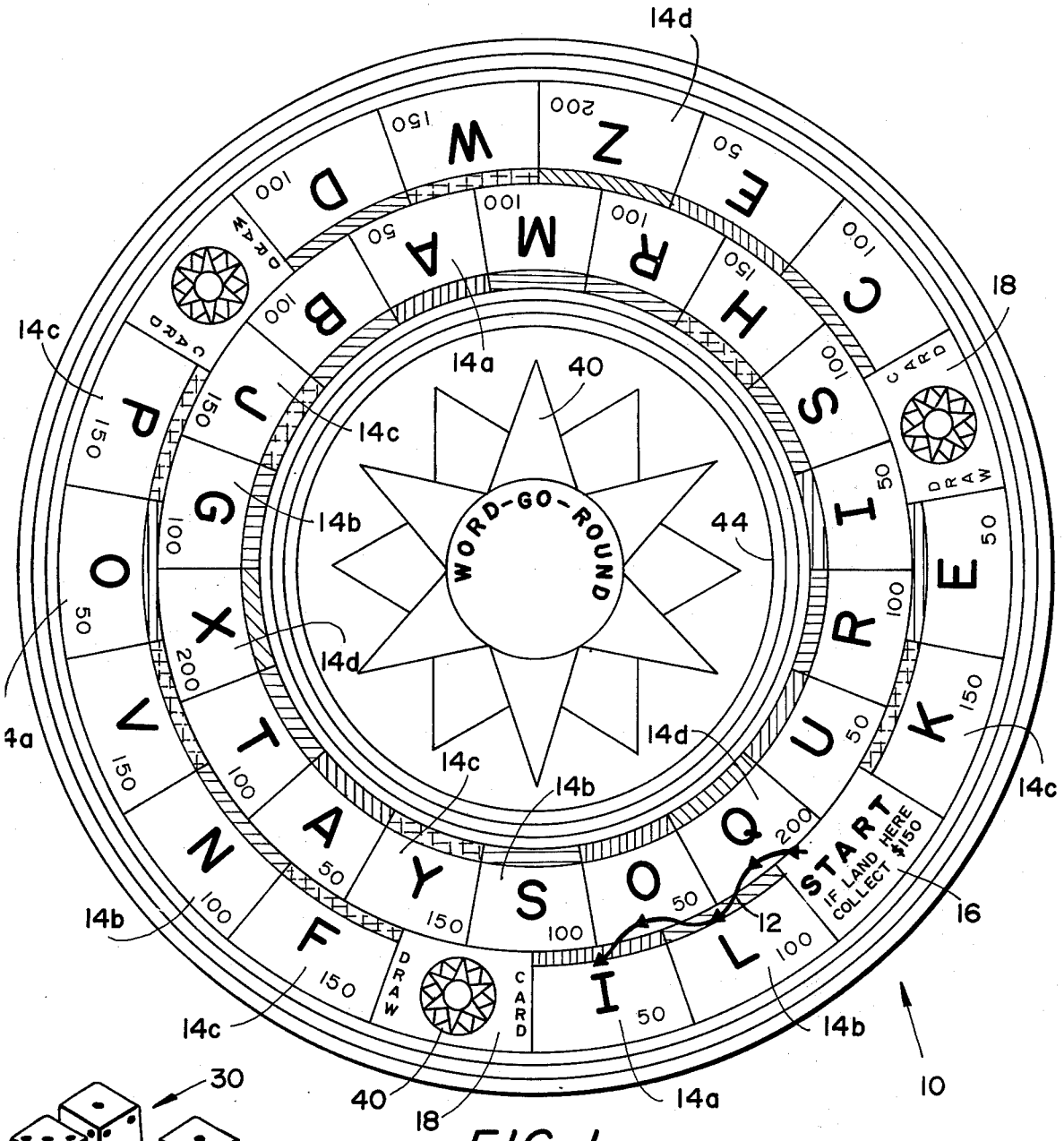
FIG. 1 is a top plan view of a game-board comprising a feature of this invention.

Referring now to FIG. 1 with greater particularity, there is shown a game-board 10 which, as shown, may be circular in configuration and has delineated thereon a continuous path 12 (shown partially) for movement of game pieces, said path comprising a series of spaces 14*a*, 14*b*, 14*c* and 14*d*, most of which indicate thereon a letter of the alphabet. As indicated by the arrows in the lower right quadrant, the path to be followed by the game pieces is a zig-zag one alternating between the outer and inner circular rows of spaces. One space 16 is marked "Start" from which play is initiated and offers a financial reward as indicated for landing thereon after completing a circuit. Other spaces 18 are marked to indicate the drawing of an instruction card to be hereinafter described.

The letters of the alphabet are formed in four groups, with a value placed on each group in accordance with the difficulty of forming words therewith. For example, the spaces 14*a* with red indicia therein contain the vowels valued at $50.00; blue spaces 14*b* contain common consonents such as *b,c,d,g,l,m,n,r,s,* and *t,* each valued at $100.00; orange marked spaces 14*c,* indicating less common consonents such as *f,h,j,k,p,w,v* and *y,* are valued at $150.00; and green marked spaces 14*d* containing the most uncommon consonents *q,x* and *z* are valued at $200.00. Also provided as part of the game equipment are a plurality of tiles 20*a,* 20*b,* 20*c* and 20*d* each bearing a letter of the alphabet and each being marked with the monetary value assigned thereto and preferably also being coded as indicated, in colors corresponding to those on the lettered game-board spaces 14*a* – 14*d*.

Figure 2:
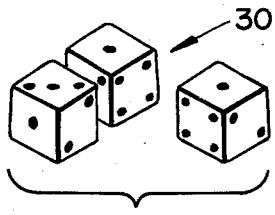
FIG. 2 is a view in perspective showing dice used in playing the game.
Figure 3:
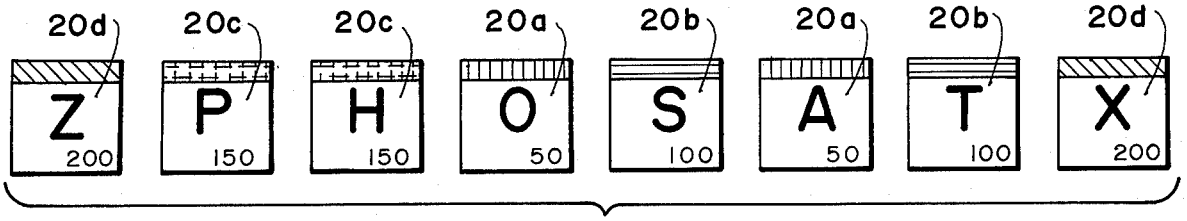
FIG. 3 is a plan view of a group of letter tiles used in the game.
Figure 5:
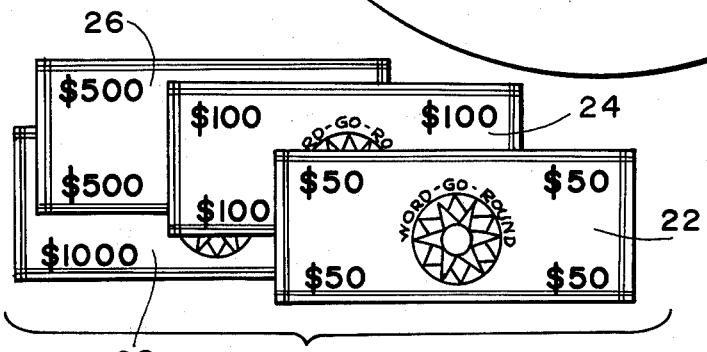
FIG. 5 is a top view of play money bills of various denominations.

At the begining of the game, each player is provided with a quantity of play money, which is shown in FIG. 5 in four denominations as $50 notes 22, $100 notes 24, $500 notes 26 and $1,000 notes 28. All letter tiles or markers 20*a*– 20*d* are purchased at the same fixed price, e.g., $50, and the letter tiles to be so purchased are determined by the throw of three dice 30, shown in FIG. 2. The use of three dice presents a player with several options as to the nature of the move to be taken. That is, he may make a single move shown by the total quantity thrown; he may make a move in two increments as indicated by the throw of one die plus the sum of the other two; or he may make the move in three increments as indicated by the three numbers thrown. Thus, at the beginning of the game, when a player is anxious to accumulate letters, it is likely that he will move in multiple increments. Thereafter, the multiple option may give the player an opportunity to combine the numbers thrown in a way that will cause him to land on the space of one or more letters he is interested in acquiring.

After sufficient letter tiles 20*a* – 20*d* have been accumulated by a player to form one or more words, they may be placed on the player's own word board 32 which has just a limited number of spaces 34 so that the flexibility of choice is limited and may render the placement of words critical to utilize a maximum number of tiles.

Figure 6:
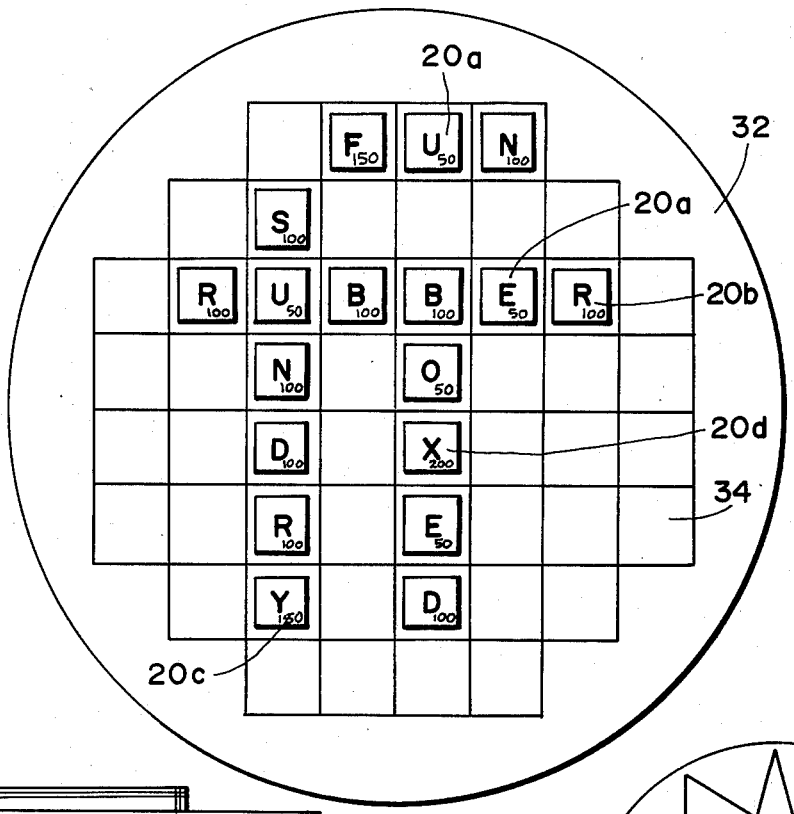
FIG. 6 is a top plan view of a player's word board illustrating how words may be placed thereon in playing this invention.

For example, as shown, with a circular gameboard there may be four horizontal and four vertical rows of eight spaces each; two in each direction of six spaces and two in each direction of four spaces, the other rows being reduced in length to fit within the confines of the circular gameboard 32. Under the rules of the game, the letters of a previously placed word may be used only as part of a word extending perpendicularly thereto, as indicated in FIG. 6, and additional letters may not be added to form the plural, for example, or to form longer words, as for example, "spark" from "ark". The game is terminated when a player establishes that no more words may be formed on his word board 32 and the winner is declared to be the person who has earned and accumulated the most money through placement of words. It is to be noted that words need not be built on previously placed words. Hence, a player should attempt to occupy all spaces not adjacent to a previous letter.

Figure 7:
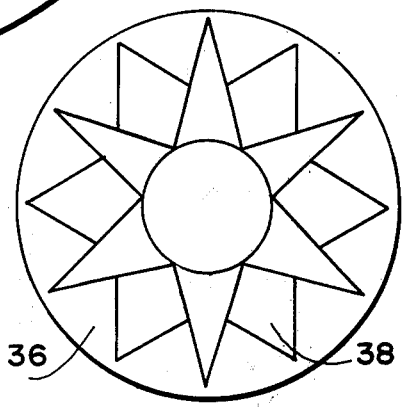
FIG. 7 is a plan view of instruction cards.
Figure 8:
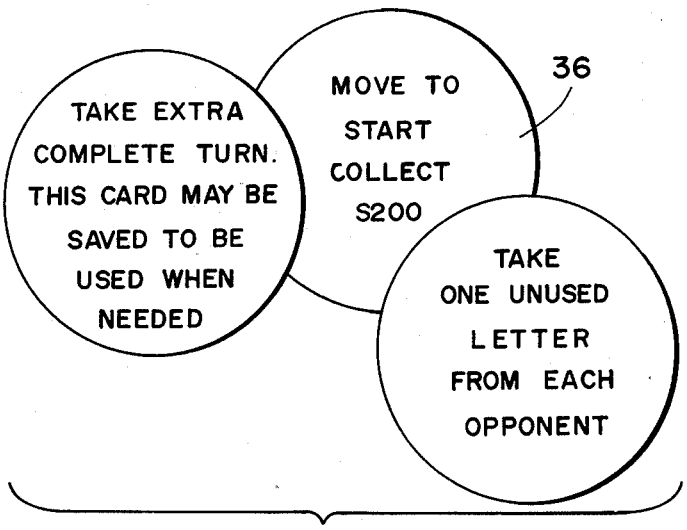
FIG. 8 is a top view of the instruction cards showing typical legends appearing thereon.

Referring to FIGS. 7 and 8, a player landing on one of the instruction card spaces 18 is required to select one of the instruction cards 36 bearing a symbol 38 on the back corresponding to that shown at 40 in the space 18. As indicated, such instruction card 36 may direct him to make a particular move or to give or take letter tiles previously purchased.

Figure 4:
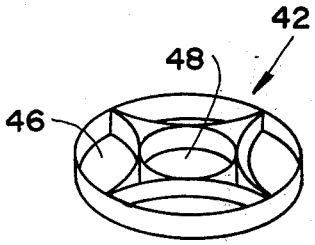
FIG. 4 is a view in perspective showing a game piece tray.

Referring to FIG. 4, I also provide a circular tray 42 which may be placed in the center circle 44 of the gameboard 10 with quadrant trays 46 being fashioned to receive the letter tiles 20*a* – 20*d,* with letters of each group occupying one of the quadrants. The center circular compartment 48 may be used to contain the circular instruction cards 36.

While this invention has been described in conjunction with a preferred embodiment thereof, it is obvious that modifications and changes therein may be made by those skilled in the art without departing from the spirit and scope of this invention as defined by the claims appended hereto.

Having described my invention, I claim:

1. Game apparatus comprising:

a game board;

a track on said game board having a series of spaces forming a continuous path along which a game piece is moveable in increments;

each of certain of said track spaces representing a letter of the alphabet;

a plurality of marker tiles, each having thereon a letter of the alphabet and indicia of a monetary value assigned to that letter, there being at least two groups of letter tiles valued in accordance with the frequency of their appearance in words of a language;

a second playing board for each player;

each second playing board having delineated thereon a limited number of horizontal and vertical rows of spaces for placement of said tiles thereon by said each player;

at least two dice each with numbering indicia on the sides thereof to be thrown so that moves along said track may be made, selectively, at the election of the player throwing, in increments corresponding to the numbers thrown, taken separately or as sums thereof; and a quantity of play money for rewarding the formation on said second playing board of complete words from letters on said tiles as indicated by the sum of the monetary values thereon;

each complete word so formed to be horizontally and vertically spaced from others on the limited spaces of a player's own second playing board unless horizontal and vertical words are linked by a common letter.

2. The game apparatus defined by claim 1 including;

a plurality of instruction cards, each directing the recipient thereof to take an action relating to said track or said tiles, and at least one additional space on said track directing one whose game piece lands thereon to take one of the said instruction cards.

3. The game apparatus defined by claim 1 wherein:

there are three said dice whereby the throwing player's election of increments to be moved is from one of the following:

one increment, as measured by the sum of all three;

two increments, as measured by any one die and by the sum of the other two; and three increments, as indicated by the three dice taken separately.

4. The game apparatus defined by claim 1 wherein;

there is no horizontal or vertical row of spaces on said second playing board in excess of eight spaces in length.

5. The game apparatus defined by claim 1 wherein;

there are four groups of letter tiles, with the vowels comprising the lowest valued group.

6. The game apparatus defined by claim 1 wherein each of said certain spaces has one of said value indicia thereon.

7. The game apparatus defined by claim 4 wherein:

each said second game board is generally circular in configuration; and horizontal and vertical rows of spaces remote from the horizontal and vertical diameters, respectively, have fewer spaces than those adjacent to said diameters.

8. The game apparatus defined by claim 1 including:

a circular tray; and arcuate panels dividing said tray into compartments, each for receiving a group of said marker tiles.

9. The game apparatus defined by claim 8 wherein:

said track is delineated around at least one circular row of said spaces; and said circular tray is adapted to be positioned within said circular row of spaces.

* * * * *